US006862764B2

(12) United States Patent
Ping

(10) Patent No.: US 6,862,764 B2
(45) Date of Patent: Mar. 8, 2005

(54) MULTI TOOL

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 82 days.

(21) Appl. No.: 10/424,014

(22) Filed: Apr. 28, 2003

(65) Prior Publication Data

US 2004/0211007 A1 Oct. 28, 2004

(51) Int. Cl.[7] ..... B25B 7/22
(52) U.S. Cl. ..... 7/128; 7/125
(58) Field of Search ..... 7/125–137

(56) References Cited

U.S. PATENT DOCUMENTS

| | | | | |
|---|---|---|---|---|
| 4,364,104 | A | | 12/1982 | Holahan et al. |
| 4,918,775 | A | | 4/1990 | Leu |
| D336,415 | S | | 6/1993 | Cheng |
| 5,626,414 | A | | 5/1997 | Chen |
| 5,697,114 | A | | 12/1997 | McIntosh et al. |
| 5,711,194 | A | | 1/1998 | Anderson et al. |
| 5,857,268 | A | | 1/1999 | Park |
| 5,916,277 | A | | 6/1999 | Dallas |
| 5,970,553 | A | | 10/1999 | Lin |
| 6,027,224 | A | | 2/2000 | Schnell |
| 6,047,426 | A | | 4/2000 | McIntosh et al. |
| 6,109,148 | A | * | 8/2000 | Anderson et al. ..... 81/440 |
| 6,119,560 | A | | 9/2000 | Anderson et al. |
| D431,986 | S | | 10/2000 | McCalla et al. |
| 6,142,769 | A | | 11/2000 | Walker |
| 6,233,769 | B1 | * | 5/2001 | Seber et al. ..... 7/128 |
| 6,260,453 | B1 | * | 7/2001 | Anderson et al. ..... 81/440 |
| 6,273,582 | B1 | | 8/2001 | Taggart et al. |
| 6,296,365 | B1 | | 10/2001 | McCalla et al. |
| 6,325,522 | B1 | | 12/2001 | Walian |
| 6,341,423 | B1 | * | 1/2002 | Taggart et al. ..... 30/169 |
| 6,347,875 | B1 | | 2/2002 | Painsith |
| 6,493,893 | B1 | | 12/2002 | Ackeret |

* cited by examiner

*Primary Examiner*—David B. Thomas
(74) *Attorney, Agent, or Firm*—Joseph J. Previto

(57) ABSTRACT

A multi-tool having a pair of jaws pivotally mounted to each other. Each jaw has a grip head and rear extension. A hollow handle pivotally mounted on each of the rear extensions. Each hollow handle has a rear end and a front end and is pivotally mounted to rear extension at its front end. The jaws being pivotally foldable relative to the handles from a folded position to an unfolded position. A flashlight is pivotally mounted on one of the hollow handles and is pivotally movable from a closed position within the hollow handle to an open position outside of the hollow handle, a plurality of auxiliary tools mounted on a pivot at the rear end of the other hollow handle and moveable from a closed position within the hollow handle to an open position outside the hollow handle.

6 Claims, 6 Drawing Sheets

MULTI TOOL

BACKGROUND

The present invention relates to multi-tools and more particularly relates to multi-tools which have an auxiliary tool comprising a flashlight.

Multi-tools have been used for a number of years. However, some of these multi-tools do not have a flashlight attached thereto nor do they have a flashlight which may be easily closed into the tool or opened from the tool.

OBJECTS

The present invention overcomes these difficulties and has for one its objects the provision of an improved multi-tool which has an flashlight mounted therein Another object of the present invention is the provision of an improved multi-tool that has a flashlight which may be closed within a handle of the tool.

Another object of the present invention is the provision of an improved multi-tool in which the flashlight may be used whether or not the tool is in its folded position.

Another object of the present invention is the provision of an improved multi-tool in which auxiliary tools has improved means for locking them in place when they are in the open position.

Another object of the present invention is the provision of an improved multi-tool which is simple to use and inexpensive to manufacture and operate.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
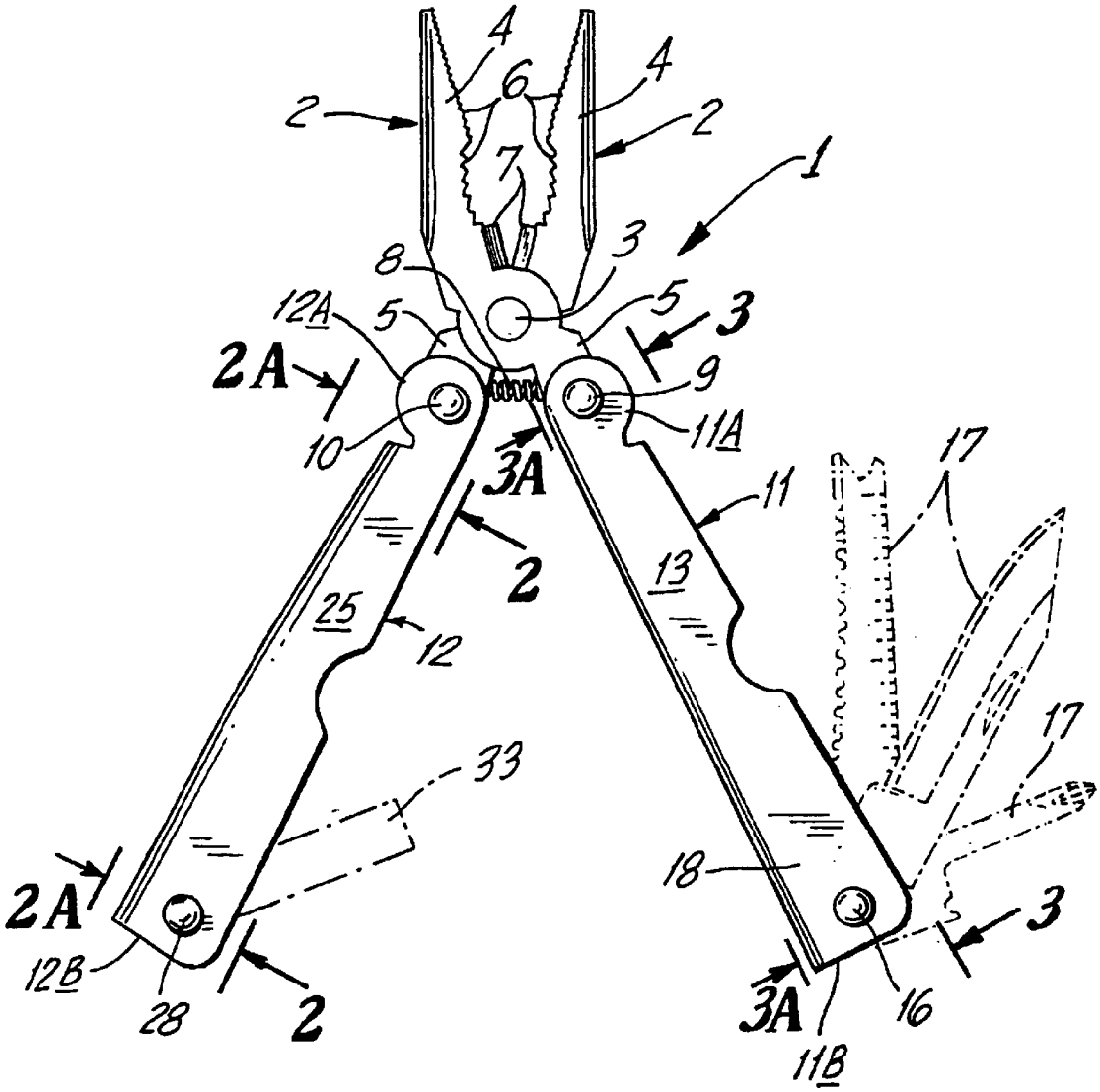
FIG. 1 is a plan view of a multi-tool made in accordance with the present invention showing the tool in an unfolded position with auxiliary tools in partially open positions shown in broken lines.
Figure 2:
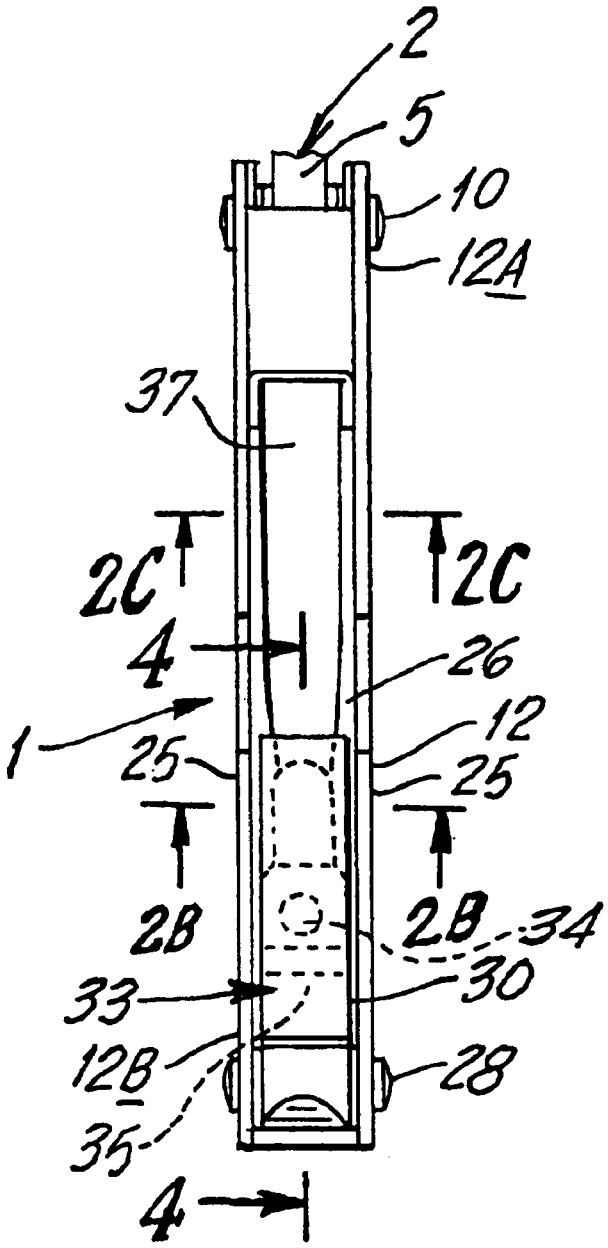
FIG. 2 is a view taken along the line 2—2 of FIG. 1.
Figure 3:
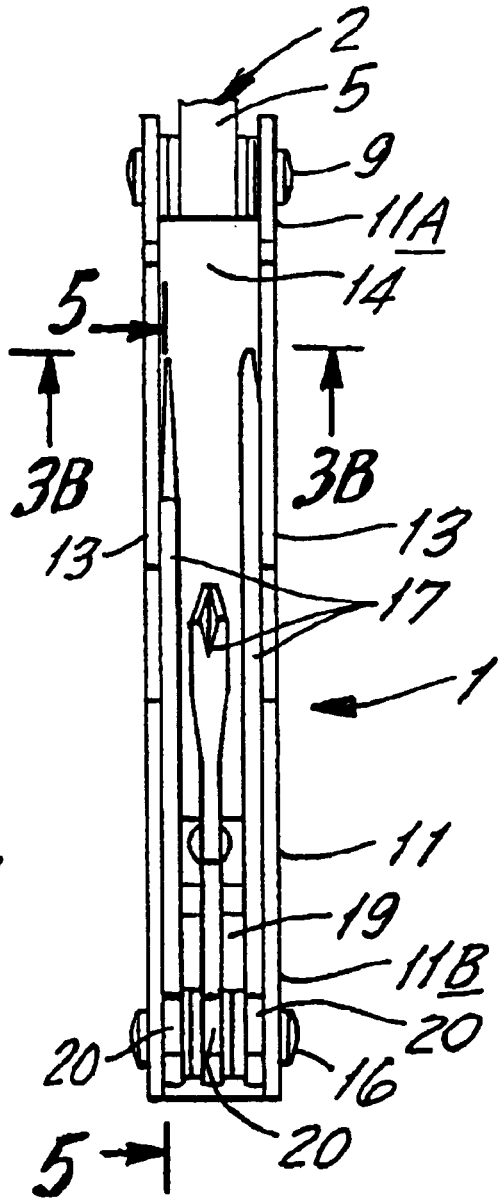
FIG. 3 is a view taken along the line 3—3 of FIG. 1.
Figure 2A:
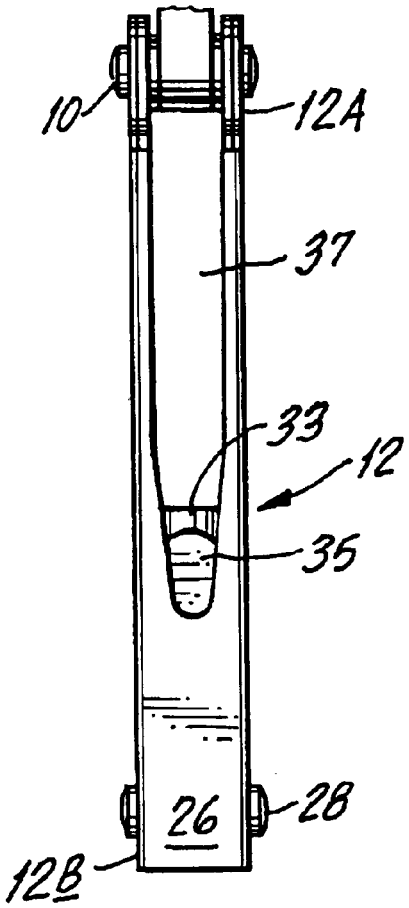
FIG. 2A is a view taken along line 2A—2A of FIG. 1.
Figure 3A:
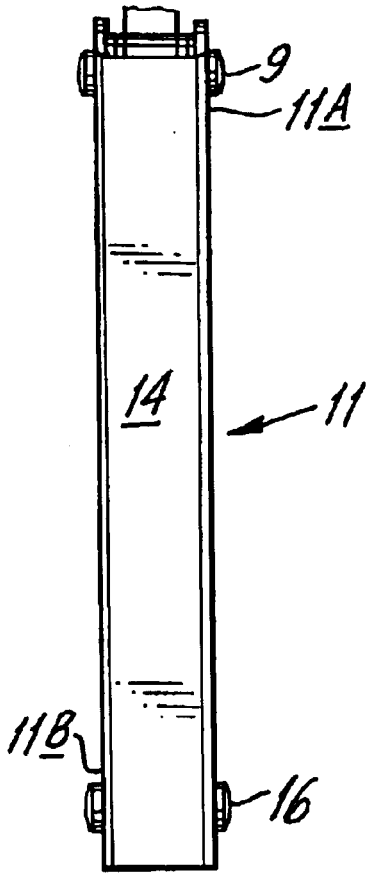
FIG. 3A is a view taken along line 3A—3A of FIG. 1.
Figure 2B:
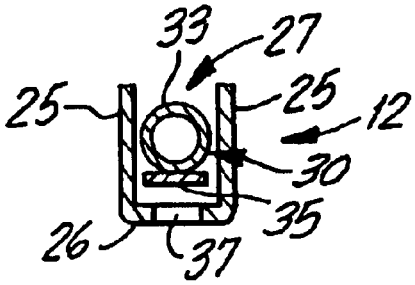
FIG. 2B is a sectional view taken along line 2B—2B of FIG. 2.
Figure 3B:
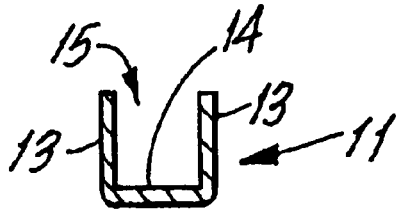
FIG. 3B is a sectional view taken along line 3B—3B of FIG. 3.
Figure 2C:
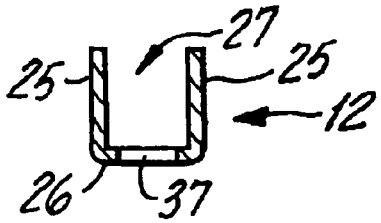
FIG. 2C is a sectional view taken along line 2C—2C of FIG. 2.

Referring to the drawings, the present invention comprises a multi-tool 1 having a pair of jaws 2 pivotally mounted to each other at the pivot 3. Each of the jaws 2 has a gripping head 4 and rear extension 5 extending rearwardly from each gripping head 4. The gripping heads 4 are each shown as having opposing teeth 6 and opposed cutting edges 7. The rear extensions 5 are provided with a spring 8 therebetween in order to keep the jaws 2 in a partially opened position when the multi-tool 1 is in its unfolded position.

Pivotally mounted on each of the rear extensions 5 by means of pivots 9 and 10 are hollow handles 11 and 12, respectively, each having front ends 11A and 12A, respectively, and rear ends 11B and 12B, respectively.

Figure 5:
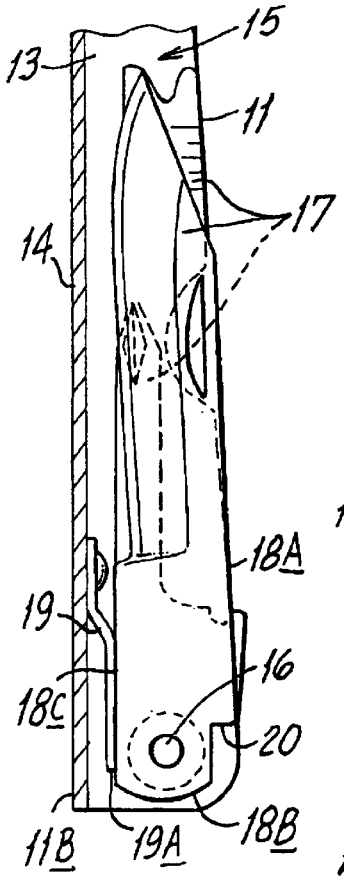
FIG. 5 is a sectional view taken along the line 5—5 of FIG. 3.
Figure 5A:
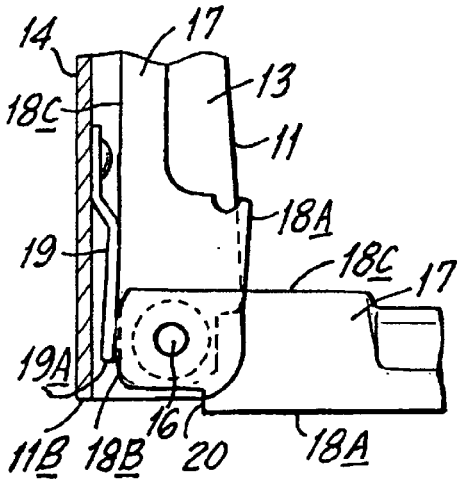
FIG. 5A is a view similar to FIG. 5 showing an auxiliary tool in a partially open position.
Figure 5B:
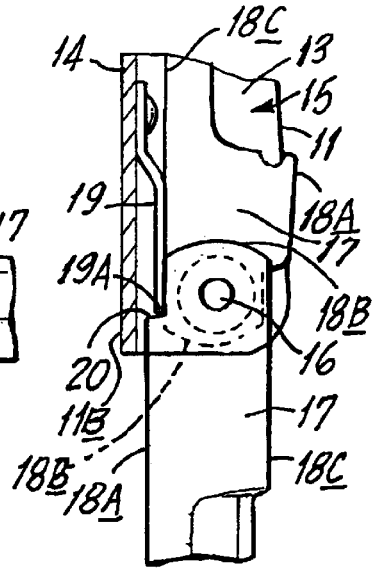
FIG. 5B is a view similar to FIG. 5 showing an auxiliary tool in a fully open position.
Figure 6:
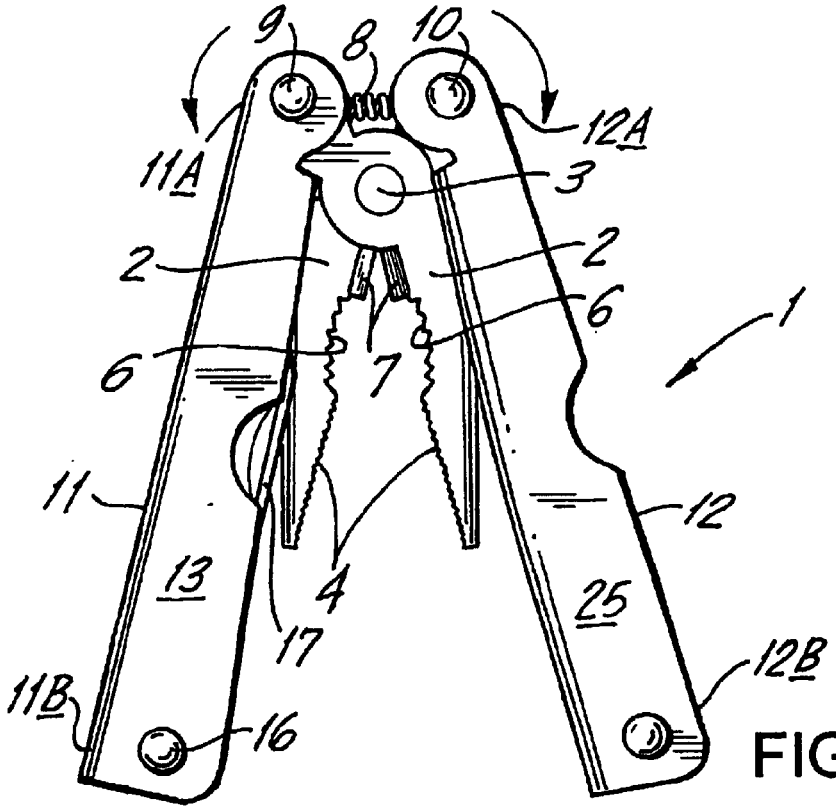
FIG. 6 is a plan view showing the multi-tool of the present invention in a partially folded position.

The hollow handle 11 is pivotally mounted at its front end 11A on pivot 9 and is generally u-shaped having a pair of upstanding side walls 13 and a bottom wall 14 connecting the side walls 13 together with the portion of the hollow handle 11 opposite the bottom wall 14 being open faced at 15. Pivotally mounted on a pivot 16 at the rear end 11B of the handle 11 are a plurality of auxiliary tools 17 which are adopted to be pivotally moved from a closed position within the hollow handle 11 to an open position outside the hollow handle 11. The auxiliary tools 17 may be a screwdriver, a file, knife, or any other desired tool. Each auxiliary tool 17 has an outer edge 18A, an end edge 18B and an inner edge 18C. Located at the rear end 11B of the hollow handle 11 and attached to the bottom wall 14 thereof is a lock spring 19 on which the inner edges 18C of the auxiliary tools 17 rest when in their closed position. The lock spring 19 has a rear end 19A and the end edge 18B of the each auxiliary tools 17 is provided with a notch 20 on its upper edge 18A. When an auxiliary tool 17 is to be opened, the auxiliary tool 17 is pivotally moved outwardly as shown in FIG. 5 so that its end edge 18B depresses the spring lock 19 until the rear end 19A of the spring lock 19 snaps into the notch 20 in the outer edge 18A of the auxiliary tool 17 to hold the auxiliary tool 17 in the open position as shown in FIG. 5B. When it is desired to close the auxiliary tool 17 back into the hollow handle 11, the auxiliary tool 17 is pivoted in the reverse direction around its pivot 16 so that its notch 20 is moved out of the rear end 19A of spring lock 19 and its end edge 18B depresses the spring lock 19 until the tool is fully closed into the hollow handle 11 with its inner edge 18C again resting on the spring lock 19.

Figure 4:
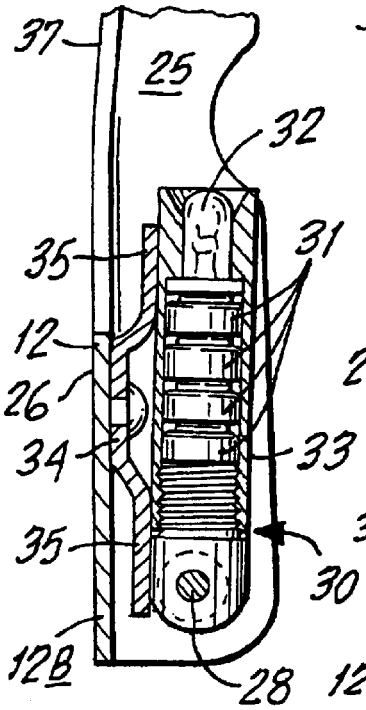
FIG. 4 is a sectional view taken along the line 4—4 of FIG. 2.
Figure 4A:
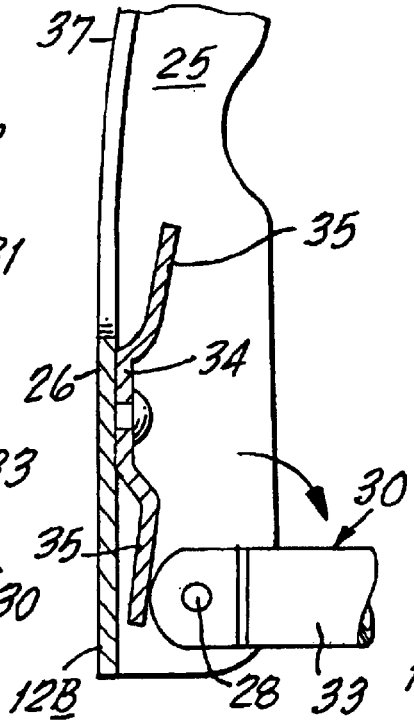
FIG. 4A is a view similar to FIG. 4 showing an auxiliary tool in a partially open position.
Figure 4B:
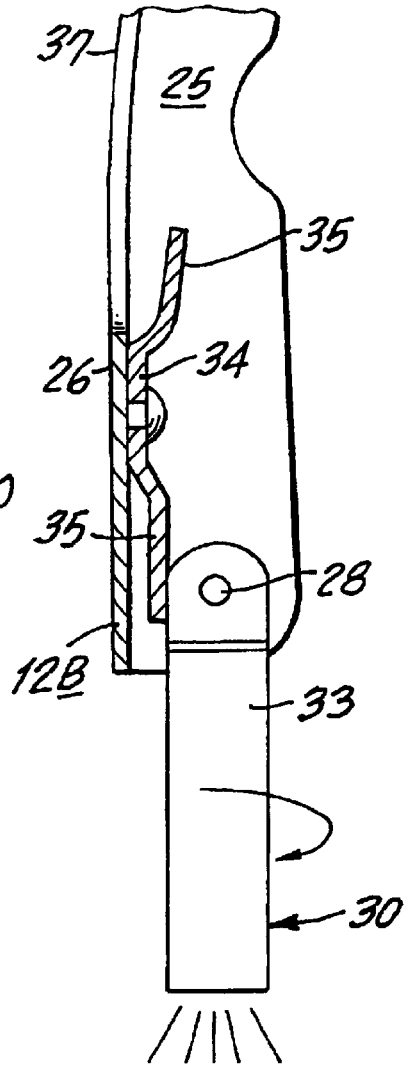
FIG. 4B is a view similar to FIG. 4 showing an auxiliary tool in its fully open position.

The other hollow handle 12 is pivotally mounted at its front end 12A on pivot 10 and is also generally U-shaped having upstanding side walls 25, a bottom wall 26 and an open face 27 opposite the bottom wall 26. An elongated groove 37 is provided in the bottom wall 26. Pivotally mounted on pivot 28 at its rear end 12B is an auxiliary tool in the form a flashlight 30 which is pivotally movable for a closed position within the hollow handle 12 to an open position outside its hollow handle 12. The flashlight 30 is prefably an LED having an outer barrel 33 and a bulb 32. In the structure shown in this drawing, the LED 30 is powered by a plurality of batteries 31 mounted within its barrel 33 which are in electrical contact with the bulb 32. By rotating the barrel 33 of the LED 30, an electrical circuit is closed and the bulb 32 will be switched on. Rotation of the barrel 33 in the opposite direction will open the electrical circuit and switch the bulb 32 off. When the LED 30 is in its closed position within the hollow handle 12, its barrel 33 rests on a support 34 having opposed arms 35 (preferably spring arms) extending in opposite directions. When the LED 30 is to be opened, it is rotated around its pivot 22 and slightly depresses one of the spring arms 35 of the support 34 as shown in FIG. 4A until the LED 30 reaches its fully open position as shown in FIG. 4B with spring arm 35 of the support 34 bearing against the LED barrel 33 to hold it in place in its extended position. At this point, the LED 30 may be switched on and off by rotating the barrel 33 in one direction of the other to close and open the electric circuitry, respectively. When it is desired to close the LED 30 back within the hollow handle 12, the LED 30 is pivoted around its pivot 27 in the opposite direction thereby again depressing the spring arm 35 until the LED 30 is fully closed within handle 12 and rests on both spring arms 35 of support 34.

It will be noted that the bottom wall 14 of the hollow handle faces 11 outwardly when the tool 1 is in its folded position and its open face 15 faces inwardly so that the auxiliary tools 17 cannot be used. These auxiliary tools 17 can be used when the tool is unfolded when its open face 15 will face outwardly. It will also be noted that when the tool 1 is folded, the open face 27 of handle 12 will face outwardly thereby permitting use of the LED 30 when the tool is folded and when the tool is unfolded the LED 30 can also be used by moving it out of its hollow handle 12 before the tool 1 is folded. Hence, the LED 30 may be used whether the tool is folded or unfolded.

Figure 7:
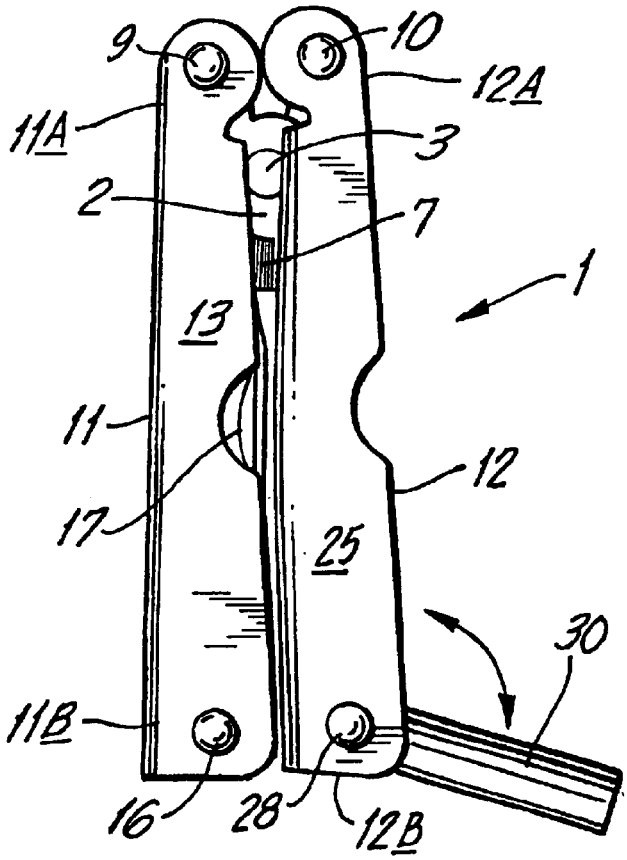
FIG. 7 is a plan view showing the multi-tool of the present invention in a fully folded position.

When the tool 1 is folded around the pivot 3, one of the jaws 2 extends through the open face 15 of the handle 11 and lies within the hollow handle 1l. However, the elongated groove 37 in the bottom wall 26 of the handle 12 permits the other jaw 2 to be received therethrough and to lie partially within the hollow handle 12. Hence, when the tool is folded as shown in FIG. 7, one jaw 2 sits in hollow handle 11 and the other jaw 2 extends through the groove 37 into hollow handle 12.

It will thus be seen that the present invention provides an improved multi-tool which has a flashlight therein which may be closed within a handle of the tool and in which the flashlight may be used whether or not the tool is in its folded position, and in which auxiliary tools have improved means for locking them in place when they are in the open position and which is simple to use and inexpensive to manufacture and operate.

As many and varied modifications of the subject matter of this invention will become apparent to those skilled in the art from the detailed description given hereinabove, it will be understood that the present invention is limited only as provided in the claims appended hereto.

What is claimed is:

1. A multi-tool comprising a pair of jaws pivotally mounted to each other, each jaw having a grip head and a rear extension, a hollow handle pivotally mounted on each of said rear extensions, each hollow handle having a rear end and a front end and being pivotally mounted to said rear extension at its front end, said jaws being pivotally foldable relative to said handles from a folded position to an unfolded position, a flashlight pivotally mounted on a least one of the hollow handles, said flashlight being pivotally movable from a closed position within said hollow handle to an open position outside of said hollow handle, a support is provided in said hollow handle upon which said flashlight rests when in its closed position, said support is attached to said hollow handle and comprises a pair of spring arms extending in opposite directions, said flashlight resting on said arms when in its closed position, a plurality of auxiliary tools mounted on a pivot at the rear end of at least one of the hollow handles and moveable from a closed position within the hollow handle to an open position outside the hollow handle, each of said auxiliary tools having an inner edge, an outer edge and a rear edge, lock means mounted in the handle with the inner edges of said auxiliary tools resting on said lock means when the tools are in their closed position and cooperating means on said auxiliary tools to cooperate with said lock means to lock the auxiliary tools in their open position, the said cooperating means comprise a notch in the outer edge of each auxiliary tool, said notch cooperating with said lock means to lock the tools in the open position, said notch having a first surface parallel to the outer edge of said tools and a second surface shorter than said first surface and at a right angle to the first surface, said lock means comprises a lock leaf spring having a rear edge adapted to be inserted in said notch when the auxiliary tools are in their open position in order to hold the auxiliary tool in said open position, said lock leaf spring having an arm, the entire length of the arm being parallel to the said outer edge and to the said first surface of said notch, whereby the entire length of said arm lies on the entire length of said first surface of said notch when the auxiliary tools are in their open position.

2. A multi-tool as set forth in claim 1 wherein said hollow handle has an open face which is adapted to face away from the jaws when the tool is in its folded position in order to permit the flashlight to be moved to its open position when the tool is in its folded position.

3. A multi-tool as set forth in claim 2 wherein said flashlight comprises a barrel and a bulb mounted on the barrel and wherein said barrel has electrical circuitry therein connected to said bulb.

4. A multi-tool as set forth in claim 3 wherein said barrel is rotatable in one direction or the other and wherein rotation of the barrel in one direction or the other will close and open said circuitry to switch the bulb on and off, respectively.

5. A multi-tool as set forth in claim 4 wherein the hollow handle has a bottom wall and wherein a groove is provided in said bottom wall, with said groove being adapted to receive a jaw of the multi-tool when the tool is in its folded position whereby the jaw extends through the said groove and at least partially into the hollow handle.

6. A multi-tool as set forth in claim 5 wherein said flashlight is an LED.

* * * * *